US008782920B2

(12) United States Patent
Marthinsen et al.

(10) Patent No.: US 8,782,920 B2
(45) Date of Patent: Jul. 22, 2014

(54) HAND-HELD HAIR DRYER

(75) Inventors: Vigdis M. P. Marthinsen, Hundhammeren (NO); Siv Elise Aasebo, Loddefjord (NO)

(73) Assignee: Dual Air AS, Trondheim (NO)

( * ) Notice: Subject to any disclaimer, the term of this patent is extended or adjusted under 35 U.S.C. 154(b) by 194 days.

(21) Appl. No.: 13/389,049

(22) PCT Filed: Jun. 21, 2010

(86) PCT No.: PCT/NO2010/000236
§ 371 (c)(1),
(2), (4) Date: Mar. 14, 2012

(87) PCT Pub. No.: WO2011/016729
PCT Pub. Date: Feb. 10, 2011

(65) Prior Publication Data

US 2012/0167406 A1 Jul. 5, 2012

(30) Foreign Application Priority Data

Aug. 6, 2009 (NO) ..... 20092808

(51) Int. Cl.
*A45D 20/10* (2006.01)
*A45D 20/12* (2006.01)

(52) U.S. Cl.
CPC ..... *A45D 20/12* (2013.01)
USPC ..... 34/97; 132/211; 392/385

(58) Field of Classification Search
USPC ..... 34/95, 96, 97, 98, 99, 100; 132/204, 132/211; 392/384, 385
See application file for complete search history.

(56) References Cited

U.S. PATENT DOCUMENTS

| | | | | | |
|---|---|---|---|---|---|
| 3,518,776 | A * | 7/1970 | Wolff et al. | 34/97 |
| 3,986,272 | A * | 10/1976 | Feierabent | 34/97 |
| 4,019,260 | A * | 4/1977 | Levy et al. | 34/97 |
| 4,218,608 | A * | 8/1980 | Maroney | 392/385 |
| 4,297,564 | A * | 10/1981 | Bartolac | 392/385 |
| 4,391,047 | A * | 7/1983 | Janssens et al. | 34/97 |
| 4,602,146 | A * | 7/1986 | Barns et al. | 392/384 |
| 5,157,757 | A * | 10/1992 | McDougall | 392/383 |
| 5,725,159 | A * | 3/1998 | Dorber et al. | 239/553.3 |
| 5,727,331 | A * | 3/1998 | Thaler et al. | 34/97 |
| 5,956,862 | A * | 9/1999 | Bondi | 34/97 |
| 5,956,863 | A * | 9/1999 | Allen | 34/97 |
| 6,038,782 | A * | 3/2000 | Schepisi | 34/97 |
| 2004/0231180 | A1* | 11/2004 | Tang et al. | 34/96 |
| 2006/0085997 | A1 | 4/2006 | Sabbatini | |
| 2008/0040943 | A1 | 2/2008 | Worgull et al. | |
| 2008/0172901 | A1* | 7/2008 | Parziale | 34/97 |
| 2012/0167406 | A1* | 7/2012 | Marthinsen et al. | 34/96 |
| 2012/0311882 | A1* | 12/2012 | Yoe | 34/98 |
| 2013/0008043 | A1* | 1/2013 | Correll et al. | 34/97 |

FOREIGN PATENT DOCUMENTS

| | | | | |
|---|---|---|---|---|
| GB | 1 559 423 | | 1/1980 | |
| GB | 2259007 | A * | 3/1993 | A45D 20/12 |
| WO | WO 2005/120283 | | 12/2005 | |

* cited by examiner

*Primary Examiner* — Steve M Gravini
(74) *Attorney, Agent, or Firm* — Ladas & Parry LLP

(57) ABSTRACT

Hand-held hair dryer having a housing provided with air inlet, an electric fan, and power supply. The hair dryer is provided with an upper air outlet and a lower air outlet extending substantially in opposite directions out from the housing and provided with heating element. The lower air outlet also serves as a grip. The housing is provided with a throttle arranged pivotably about a pivot. The throttle is operated by a button between a first position where the upper air outlet is blocked and the lower air outlet is open to air flow, and a second position where the air flows in a direction opposite of the first.

12 Claims, 4 Drawing Sheets

HAND-HELD HAIR DRYER

Figure 1:
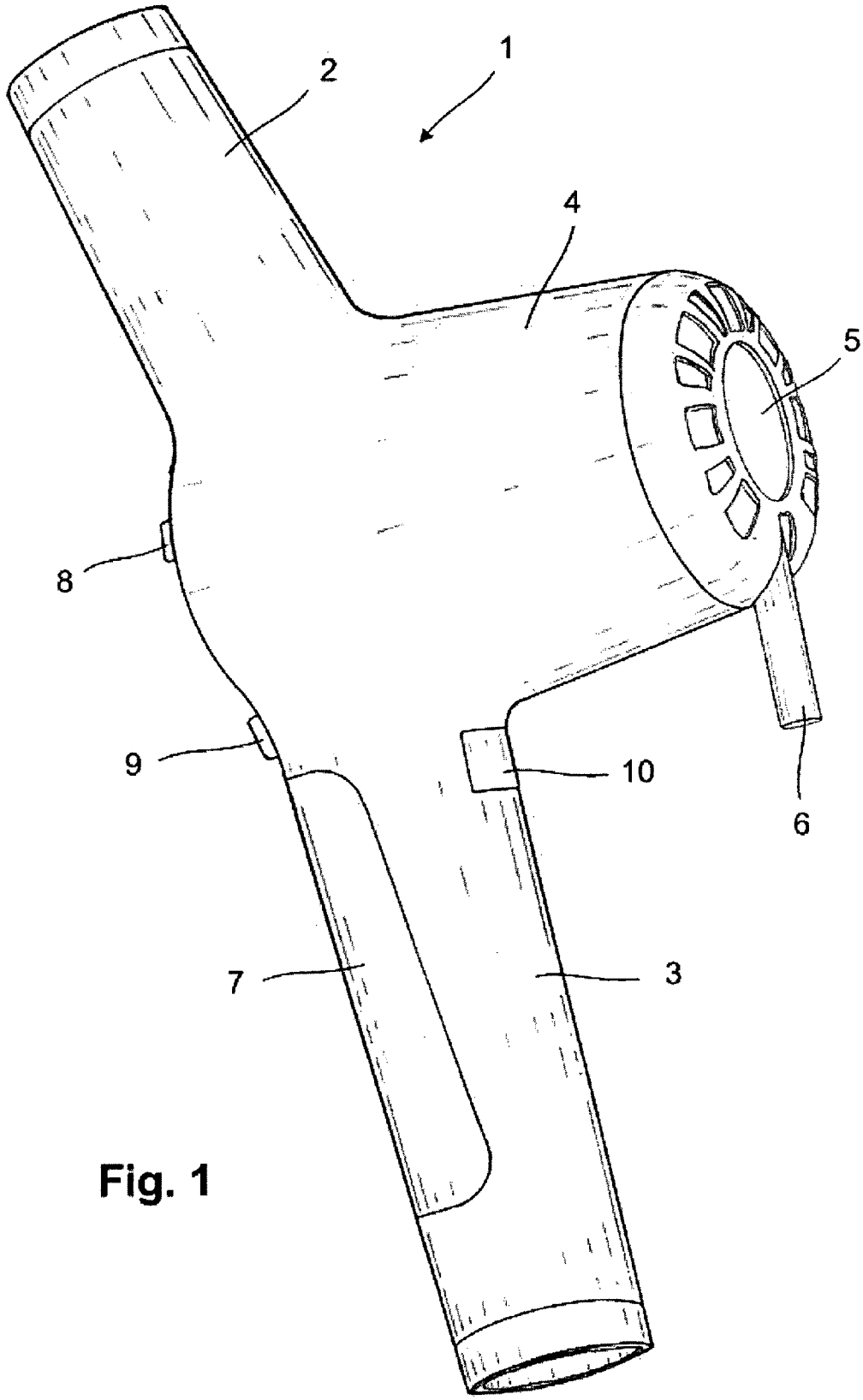

This application is a 371 of PCT/NO 2010/000236, filed on Jun. 21, 2010, which claims priority to Norwegian Patent Application No. NO 2009 2808, filed Aug. 6, 2009, the contents of which are incorporated herein by reference.

The present invention concerns a hand-held hair dryer as described in the introductory part of patent claim 1.

BACKGROUND

Hairdressers work in a vulnerable occupational group with regard to strain injuries and sick leave. A lot of hairdressers are forced to stop working long time before planned pension age. A substantial reason to this problem is the extensive use of hair dryers. When drying in the direction from top to down the hairdresser must direct the air downwards towards the hair from above, and the hairdresser must lift the arm by twisting the elbow upwards and twist the wrist to direct the air in correct direction. This results in a stress on as well shoulder as wrist. When drying in the direction bottom up the hairdresser often works in a tilted working position and with twisting movements of the wrist. When the hairdresser is about to dry the hair on top of the head, it may be difficult to direct the air in correct direction without having to stretch herself over the customer and work with elevated shoulder and arm. When the hairdresser is drying the hair at the forehead, they often want the air to come from below whereby the wrist is subjected to twisting movements. Another problem with prior art hair dryers is the grip. Prior art hair dryers have smooth grips of plastic material, which forces the hairdresser to squeeze the grip harder and correct the grip when the hands are littered with hair agents. When drying from the top in direction downwards the, thumb joint or fingers are subjected to increased stress or strain.

In addition to the hair dryers found in the hair styling saloons today, examples of hair dryers can be found in the patent literature. For example GB 1559423 and DE 2743743 show hair dryers where the grip is adjustable to a position along the same axis as the air outlet. US patent publication 2008/0040694 describes a hair dryer where the neck of the air outlet also may serve as a grip to improve the ergonomics when drying in direction downwards. A disadvantage of the latter solution is that the user must change grip from the first grip to the other. EP 1649773 describes a hair dryer having ergonomically shaped grips arranged in parallel with the air outlet direction. However, this hair dryer does not solve the problem with strain on wrists when the hairdresser is about to change air flow direction. U.S. Pat. No. 4,195,217 describes a cylindrically shaped hair dryer housing having a grip surface along the outlet.

OBJECT

The object of the invention is to provide a hair dryer, particularly for professional users, which reduces the strain on the user and attrition injuries on arms and shoulders.

THE INVENTION

This object is achieved with a hair dryer in accordance with the characterizing section of patent claim 1. Further beneficial features appear from the accompanying dependent claims.

The invention concerns a hand-held hair dryer comprising devices for air supply, a nozzle or outlet for air blowout, grip for handling the hair dryer in use, control device for controlling air transport and air temperature, and optionally heating elements for heating air.

In accordance with the invention, the hair dryer is characterized in comprising two separate outlets comprising an upper outlet and a lower outlet extending out from the air supply device for blowing out air, and guiding means arranged at the air supply device for directing the air flow either to the upper or to the lower outlet by means of a control device.

In a preferred embodiment the outlets extend in substantially opposite directions from the air supply device. In a particularly preferred embodiment the outlets are arranged in a mutual angle of about 165°.

The double-necked design of the hair dryer with the ability to direct the air flow to one neck or the other provides a substantial reduction of the strain to hands, arms and shoulders for a user who is drying the hair of another person. The example description below will illuminate details and benefits of the invention in further details.

Figure 2B:
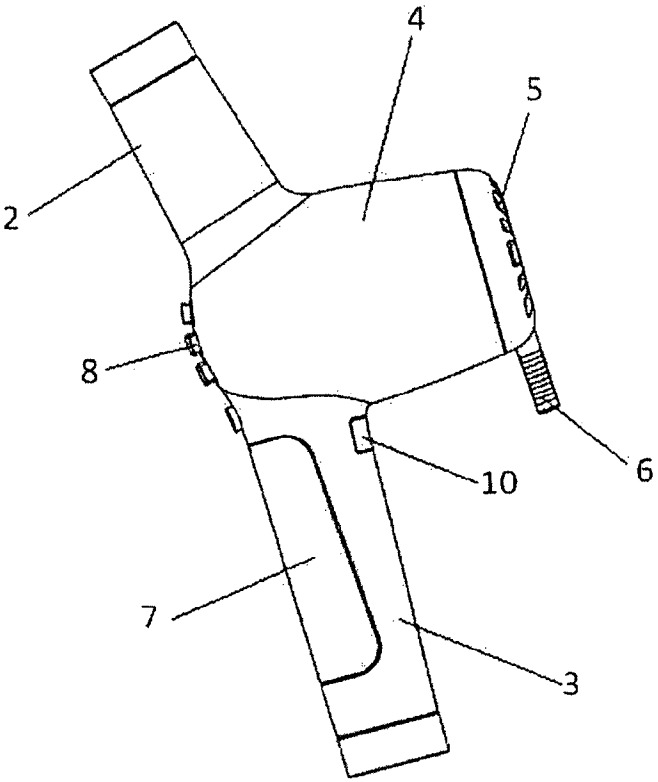
Figure 2A:
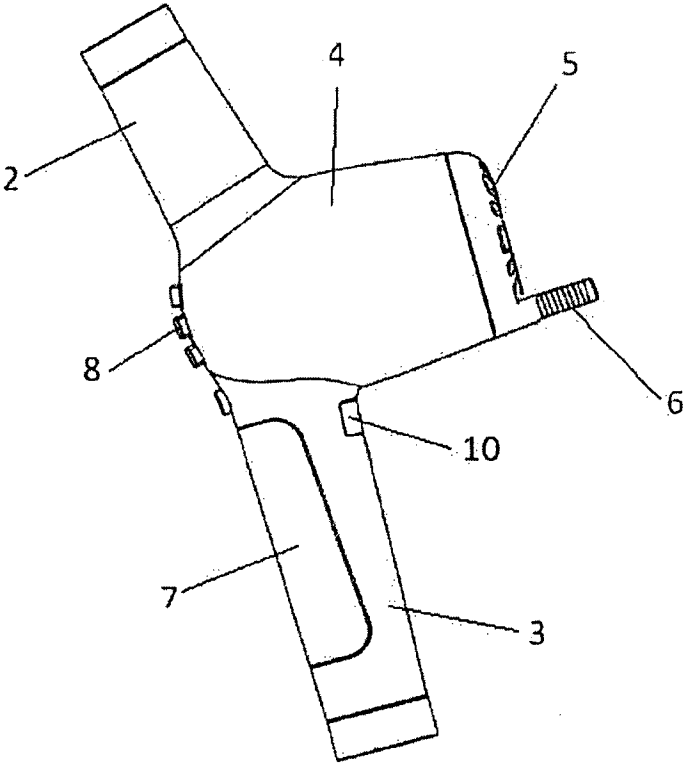
Figure 3A:
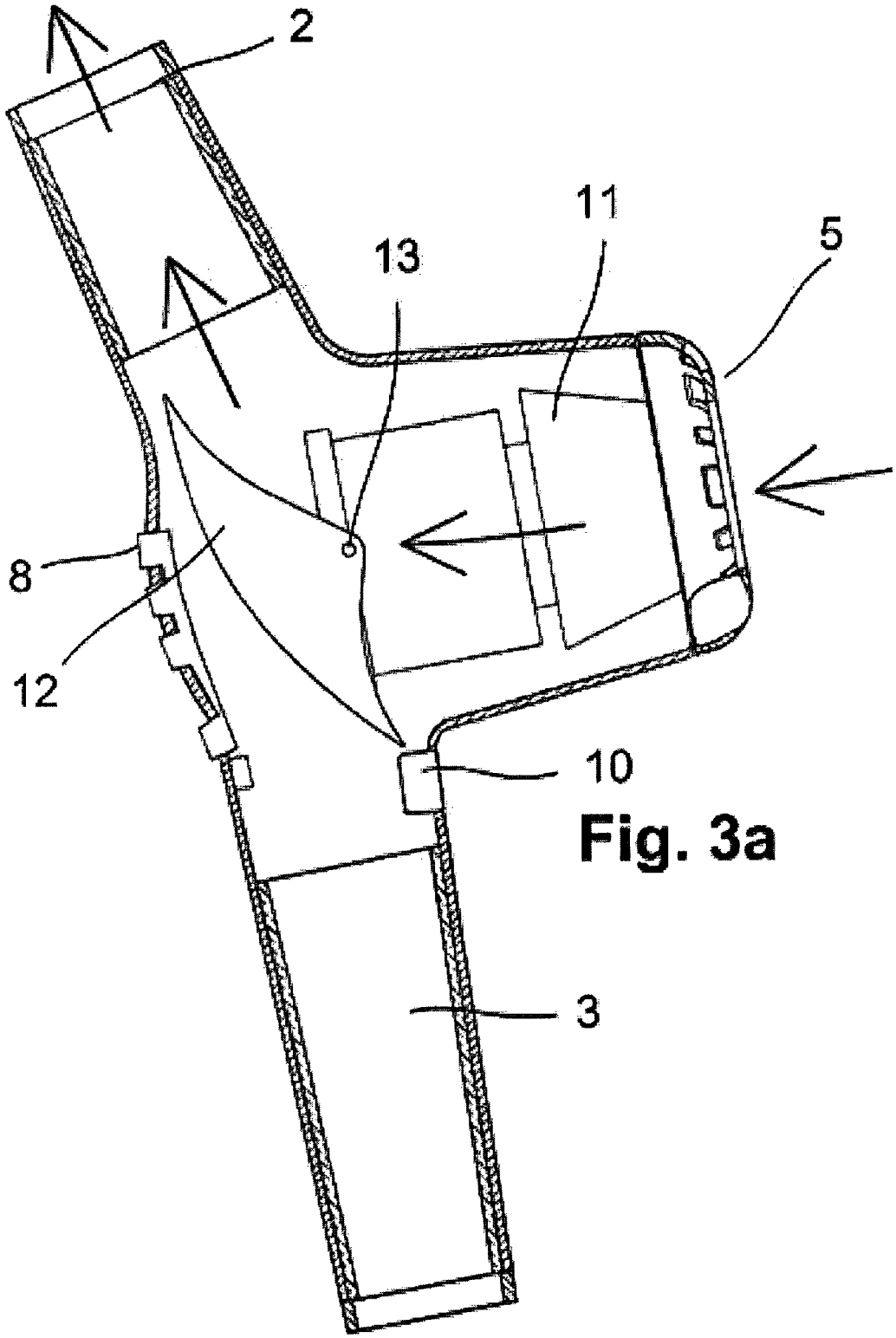
Figure 3B:
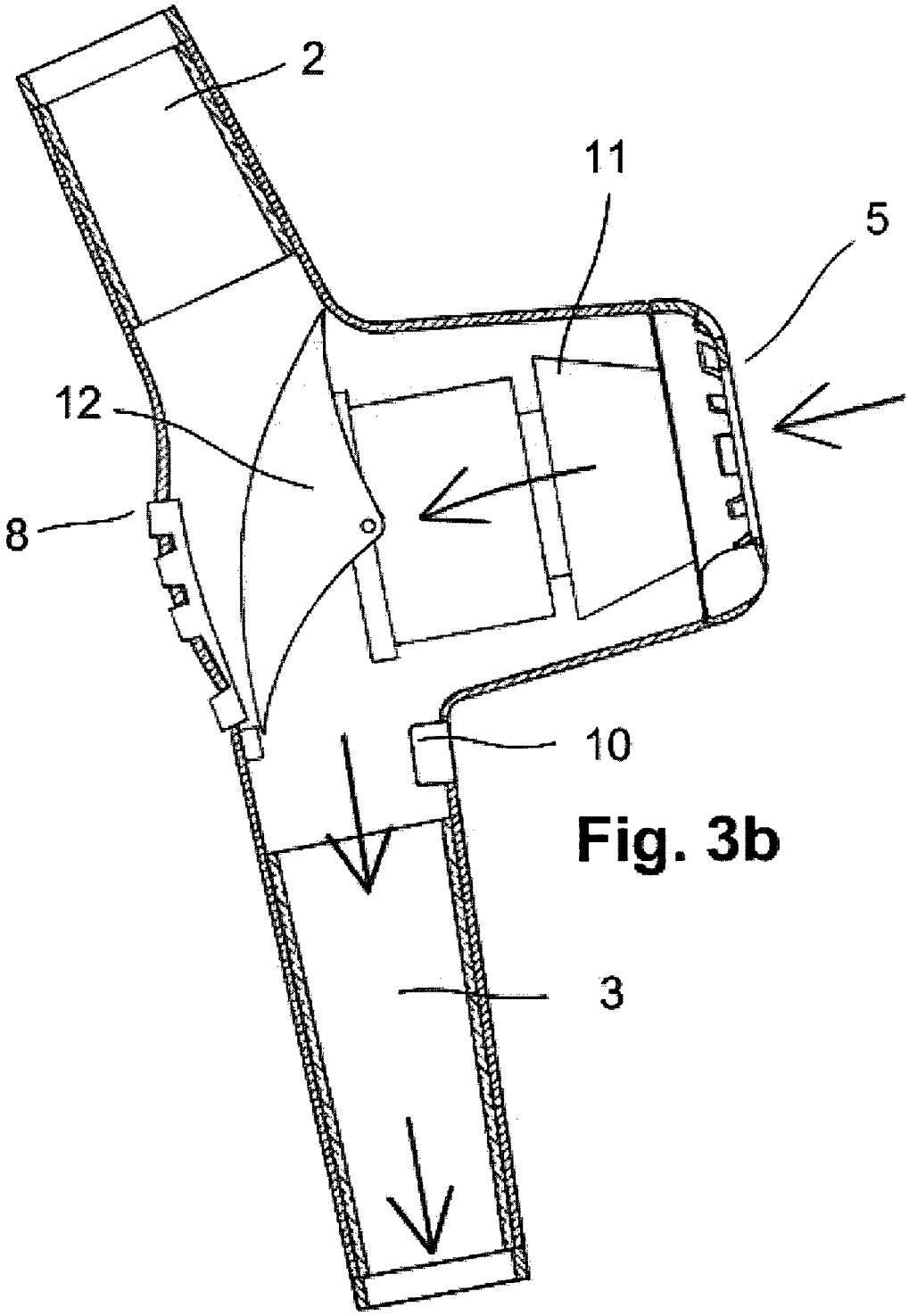

The invention is in the following described in further detail by means of an example of one embodiment supported by figures, where FIG. 1 shows a hair dryer in accordance with the invention seen from the side, FIGS. 2*a* and 2*b* show a hair dryer similar to FIG. 1, and illustrate a pivotal attachment for the power cable, and FIGS. 3*a* and 3*b* show a schematic and simplified cross section of a hair dryer in accordance with the invention having a throttle for controlling the air flow upwards or downwards, respectively.

With reference to FIG. 1, an example of an embodiment of a hand-held hair dryer in accordance with the invention is described, indicated with reference numeral 1, particularly designed for use by professionals such as hair designers and hairdressers. The hair dryer is provided with a housing 4 having an air inlet 5 and a fan 11. The novel and inventive of the hair dryer in accordance with the invention is that is exhibits two air outlets in the form of an upper outlet 2 and a lower outlet 3 extending in a substantially opposite direction from an air supply indicated generally by 4. In this way the user is enabled to dry the hair of another, usually sitting, person upwards from below, dry the top of the head and dry the front of the hair without having to twist arm and wrist to any substantial degree. Moreover, the dryer can be provided with a heating element (not illustrated), either in connection with the fan 11 in the housing 4 or in the respective outlets 2 and 3.

The grip is preferably integrated with the lower outlet 3. In this way the user does not have to lift the arm to the same elevation as with traditional hair dryers for example during drying of the top of the head. At least a part of the grip surface is preferably provided with or is formed of a material with increased friction to improve the grip about the hair dryer for a user having slippery hands from e.g. hair agents and reduce the strain on the user's hand further. This can be achieved in two ways, e.g. by rubbing or profiling the surface, by applying a coating with increased friction etc. The grip is preferably provided with or is formed of a heat insulating material to reduce heating of the hand during drying with warm air.

The flow direction can be controlled by means of a throttle or similar, as discussed in further detail in connection with FIGS. 3*a* and 3*b*, so that the air either flows out through the upper outlet 2 or through the lower outlet 3. The flow direction is controlled by means of a control device 10, here illustrated in the form of a button arranged at the upper end of the lower outlet 3 adjacent to the air supply housing 4. This location of the control device 10 for the flow direction makes it possible to hold the hair dryer in an operating position with the thumb resting against the button 10, so that the user can change the flow direction with a minimal effort.

Moreover, the hair dryer is provided with control devices known per se such as start/stop and heat controller indicated in general by numeral reference 8. The control devices 8 are in this embodiment arranged at the opposite side of the dryer facing the control device 10 for the flow direction at the air supply housing 4. A cold button 9 is arranged under the control devices 8 at the upper end of the combined air outlet and grip 3, and can easily be controlled by the index finger in the need of cold air.

The centre of gravity of the hair dryer is preferably located above the hand, i.e. in the area of the air supply housing 4 in this embodiment. If the user holds the hair dryer in a wrong manner, the user will easily feel that the centre of gravity is out of balance and encourage the user to change grip in order to correct the weight.

The outlets 2 and 3 can be arranged along the same axis, which means that they form a mutual angle of 180°. However, we have found that it is preferred to arrange the outlets with a mutual angle of about 165° so that the upper outlet 2 points or is inclined away from the user and towards the person to be styled. It should be emphasized here that the stated angles in no way represent any requirement to obtain the surprising technical effect, and a similar or substantially equal effect can be obtained with other angles than the stated.

FIGS. 2*a* and 2*b* illustrate an alternative embodiment of a hair dryer powered by electric power from the general power supply via a power cable. The power cable (not illustrated) is accommodated in a cable holder 6 which in this embodiment is connected pivotably with the air supply housing 4 in the vertical direction. This arrangement makes it easier to adapt the hair dryer to a power cable hanging from the ceiling or for a power cable lying on the floor.

FIGS. 3*a* and 3*b* show an example of a throttle 12 for directing the air flow to either the upper air outlet 2 or the lower air outlet 3 in the form of a schematic cross-section through the hair dryer 1. The throttle 12 is in this embodiment formed as an elongate arch-shaped plate connected pivotably to a fan 11 via a pivot 13. The throttle 12 is designed to be pivoted about the pivot 13 by a motor (not shown) when the user presses the button 10. FIG. 3*a* shows an operating mode where all air is blown from an inlet 5 by means of the fan 11 and up through the upper air outlet 2 whereas the throttle 12 covers the inlet opening of the lower air outlet 3. The air flow is indicated by arrows in FIGS. 3*a* and 3*b*. The arch shape of the throttle 12 reduces the flow resistance through the throttle in one direction or the other to optimize the flow speed and reduce noise. FIG. 3*b* is a figure similar to FIG. 3*a* but illustrates the situation where the air is directed through the lower air outlet 3.

The invention possesses substantial benefits compared to prior art hair dryers. The double-necked design makes it possible to dry the hair of another person from below as well as from above without having to twist the elbow vertically. Another benefit is that there is no need for the user to twist the wrist in any substantial degree since the styling can be performed with the wrist in a substantially vertical position. The ergonomic design of the grip integrated with the lower air outlet combined with the control buttons for air flow direction, cold, heat etc. results in a lower arm lifting elevation compared to prior art hair dryers. Another benefit of the grip and button design is that the strain on the fingers and in particular the thumb is minimized.

Accordingly, the hair dryer in accordance with the invention results in a substantially reduced strain on arms and shoulders of hairdressers, and the hairdressers can for that reason extend their carrier and reduce sickness leave caused by wrong working positions.

It should be emphasized that the description above illustrates an example only of an embodiment of the invention, and the hair dryer can be subjected to different variations without deviating from the basic idea of the invention. Accordingly, the angle between the respective air outlets does not have to be exactly 180° or exactly 165°. Moreover, it is conceivable that the fan motor of the hair dryer is powered by batteries or that the air is supplied via an overhead hose from an external air supply. Moreover, the illustrated air throttle can be formed in countless manners, which will be within the scope of a person with skills within the field of ventilation and air transportation.

The invention claimed is:

1. Hand-held hair dryer comprising:
- an air supply device;
- opposing upper and lower air outlets;
- air flow and air temperature control devices;
- at least one heating element for heating air;
- a guiding device arranged at the air supply device for directing air flow to either the upper or lower air outlets by means of an air flow direction control device;
- wherein said upper and lower air outlets are substantially perpendicular to the air supply device; and
- a grip located on at least one of the upper and lower air outlets so that the hair dryer can be held by the upper and lower air outlets.

2. The hair dryer of claim 1, wherein the guiding device for directing air flow comprises a throttle pivotally connected to the air supply device and connected operatively with an actuator for pivoting the throttle to a position blocking the air flow to the upper air outlet, and opening the air flow to the lower air outlet, and vice versa.

3. The hair dryer of claim 1, wherein the grip is integral with the lower air outlet and wherein the grip is provided with a heat insulating material.

4. The hair dryer of claim 3, wherein the air flow direction control device is arranged at an upper part of the combined lower air outlet and grip.

5. The hair dryer of claim 1, wherein the air flow is produced by a fan driven by an electric motor integral with the hair dryer powered by electricity from a power outlet via a cable, wherein the cable is arranged in a holding device connected pivotally to the hair dryer housing in a vertical direction.

6. The hair dryer of claim 1, wherein at least a part of the grip is provided with a surface having increased friction.

7. The hair dryer of claim 1, wherein the upper and lower air outlets are arranged in a mutual angle of about 165°.

8. The hair dryer of claim 1, wherein the upper and lower air outlets are arranged in a mutual angle of about 180°.

9. The hair dryer of claim 2, wherein the throttle is arch-shaped so that when the throttle is in an operating position, the throttle forms an arch-shaped channel from the air supply device to the respective upper and lower air outlet.

10. The hair dryer of claim 1, wherein the heating element is connected to the air supply device.

11. The hair dryer of claim 1, wherein heating elements are provided in each of the upper and lower air outlets.

12. The hair dryer of claim 1, wherein a longitudinal axis of the upper and lower air outlets is substantially perpendicular to a longitudinal axis of the air supply device.

* * * * *